United States Patent [19]

Breuker et al.

[11] Patent Number: 4,726,754

[45] Date of Patent: Feb. 23, 1988

[54] MOLDING PRESS FOR REACTION INJECTION MOLDING

[75] Inventors: Gordon Breuker; Rodger Dangremond; Jerry V. Scrivo, all of Holland, Mich.

[73] Assignee: Ex-Cell-O Corporation, Walled Lake, Mich.

[21] Appl. No.: 779,008

[22] Filed: Sep. 23, 1985

[51] Int. Cl.[4] ..... B30B 1/32

[52] U.S. Cl. ..... 425/406; 100/226; 100/257; 425/409; 425/451.5; 425/592; 425/543

[58] Field of Search ..... 100/226, 257; 425/195, 425/406, 408, 409, 411, 441, 442, 453, 454, 450.1, 451.9, 451.2, 451.5, 150, 188, 193, 547

[56] References Cited

U.S. PATENT DOCUMENTS

| | | | |
|---|---|---|---|
| 2,692,407 | 10/1954 | Stacy | 425/451 |
| 2,812,543 | 11/1957 | Stacy | 425/406 |
| 2,820,250 | 1/1958 | Stratton | 425/406 |
| 3,345,691 | 10/1967 | Aoki | 425/451.2 |
| 4,191,523 | 3/1980 | Niederst et al. | 425/450.1 |
| 4,212,614 | 7/1980 | Holzinger | 425/214 |
| 4,502,379 | 3/1985 | Sato | 100/257 |
| 4,561,626 | 12/1985 | Black | 425/214 |

*Primary Examiner*—Jay H. Woo
*Assistant Examiner*—J. Fortenberry
*Attorney, Agent, or Firm*—John C. Evans

[57] ABSTRACT

A press for holding mold segments that are joined to form a mold cavity into which liquid chemicals are injected and reacted to form solid objects includes tie bar extenders to provide field adjustment of the press geometry and further includes booking plate spacers to unload booking plate hinge pins during mold clamping.

2 Claims, 8 Drawing Figures

FIG. 2
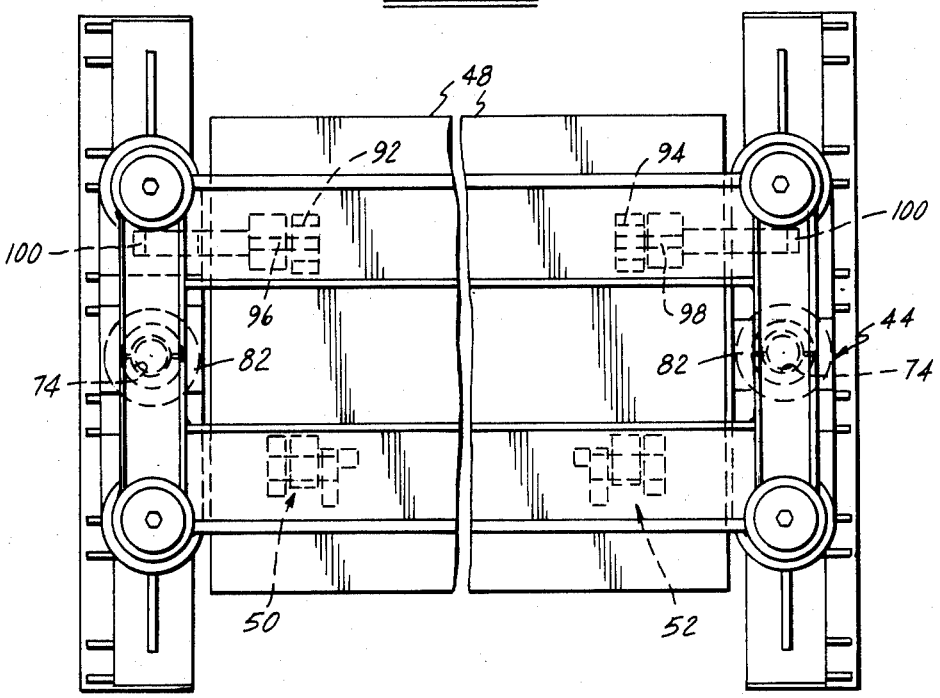
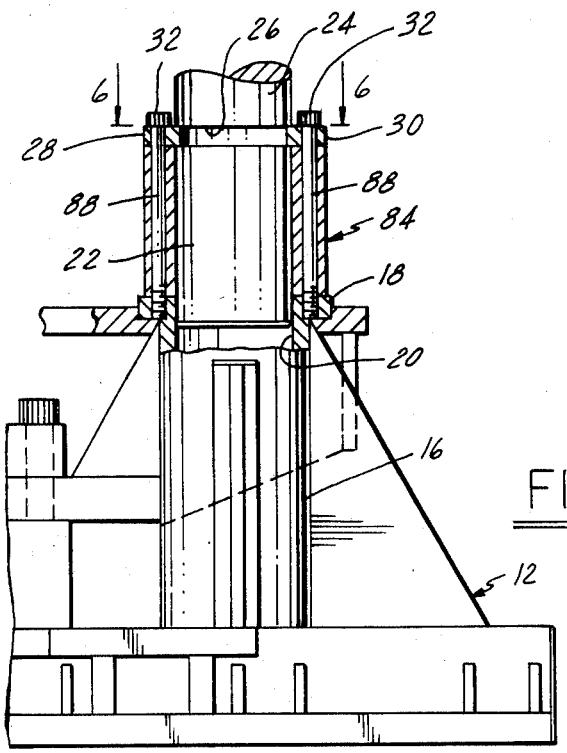
FIG. 5
FIG. 6
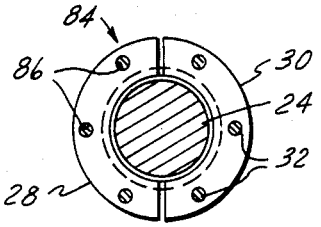

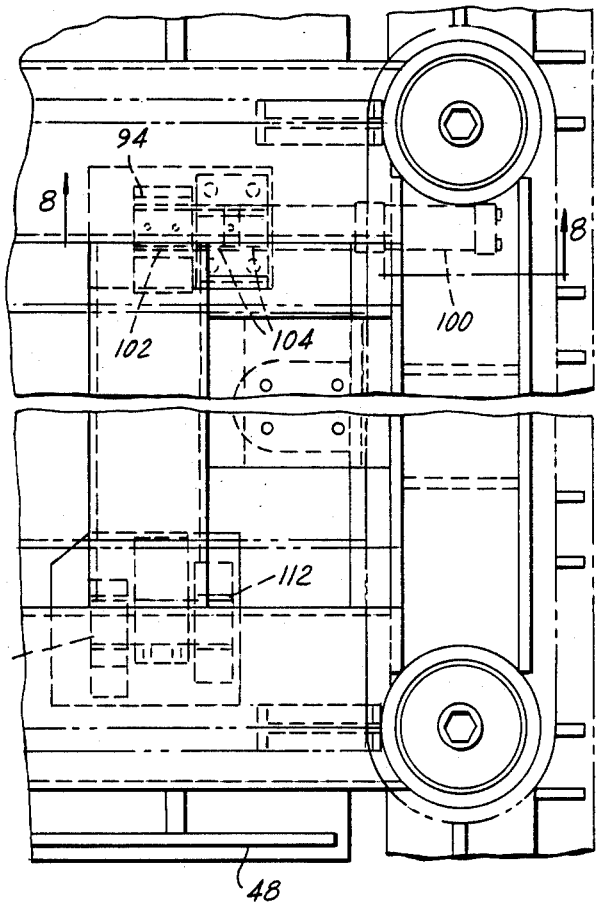
FIG. 7
FIG. 8
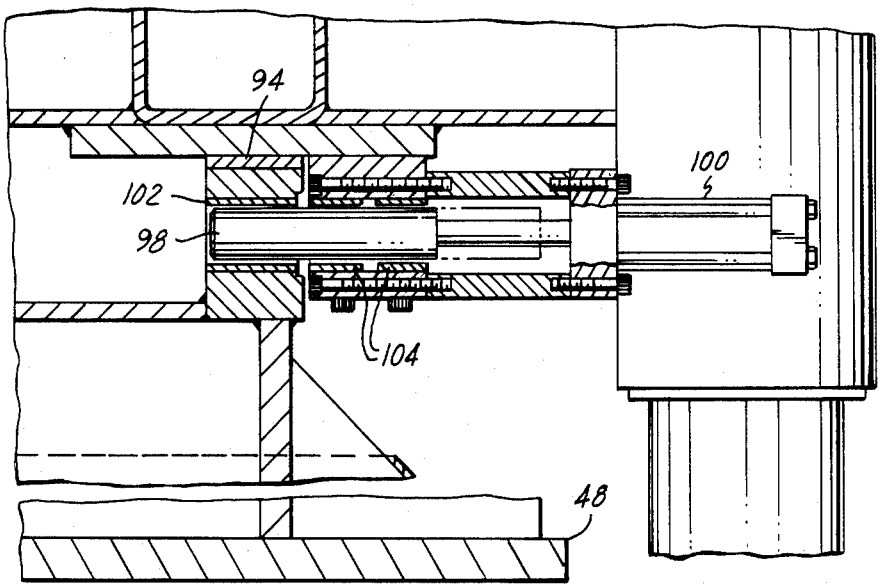

MOLDING PRESS FOR REACTION INJECTION MOLDING

BACKGROUND OF THE INVENTION

This invention relates to molding presses and more particularly to molding presses for reaction injection molding processes.

Various molding presses have been suggested for processes that form solid articles from liquid chemicals. Presses of the types shown in U.S. Pat. Nos. 3,981,671 and 4,191,523 have included booking plates that are pivoted to increase the window space for access to parts formed by the processes. These presses have a press geometry which is fixed by side frame members. Other light weight molding presses of the type shown in U.S. Pat. No. 3,247,545 have included tie-bolts that form part of the access port to molded parts. Such tie-bolt systems have a press geometry which is unsuited for pivotal type booking plates.

SUMMARY OF THE INVENTION

An object of the present invention is to provide an improved tie-bar type molding press with means to improve platen guidance and parallelism and wherein means are provided to pivotal booking plates with respect to frame components of the press which can be height adjusted.

Another object of the present invention is to provide a molding press with a base frame having tie-bar extenders at each corner to field adjust the press and height and wherein each of the extenders receives a tie-bar connected at its opposite end by a frame for maintaining tie-bar parallelism thereby to maintain operating parallelism of the movable platen and booking plates of the assembly.

A further object of the invention is to provide a mold press with adjustable geometry and pivotal booking plates by the provision of field height adjustable tie-bars and by the further provision of a four tie-bar support and stroking cylinders that do not load the tie-bars during molding.

In the preferred embodiment the molding press includes a rectangular press base adaptable to receive a tie-bar extender at each corner of the base. A tie-bar can be supported on each extender to be field adjustable by the extender to adjust access geometry to the press. A rigid top frame is connected to the upper end of each tie-bar to maintain parallelism between booking plates on the base and a platen which includes corner guides slidably supported on the upstanding tie-bars. Each booking plate is pivotally supported and driven by an off-center stoking cylinder to provide ease of access to a molded part and mold segments when the mold is separated. Two spaced clamp cylinders are provided at opposite end of the frame to drive the movable platen with respect to the tie-bars without loading the tie-bars on the pivot supports for the booking plates.

Other objects and advantages and a more complete understanding of the invention will be apparent to those skilled in the art from the succeeding detailed description of the invention and the accompanying drawings thereof.

BRIEF DESCRIPTION OF THE DRAWINGS

FIG. 2 is a top elevational view of the molding press of FIG. 1;

FIG. 5 is an end view of a tie-bar extender of the present invention;

FIG. 6 is a top view of the tie-bar mounting detail to the press base.

FIG. 7 is a fragmentary top elevational view, partially broken away to show hinge and stripping pin details; and FIG. 8 is a side elevational view in the direction of the arrow 8 in FIG. 7.

DESCRIPTION OF THE PREFERRED EMBODIMENT

Figure 1:
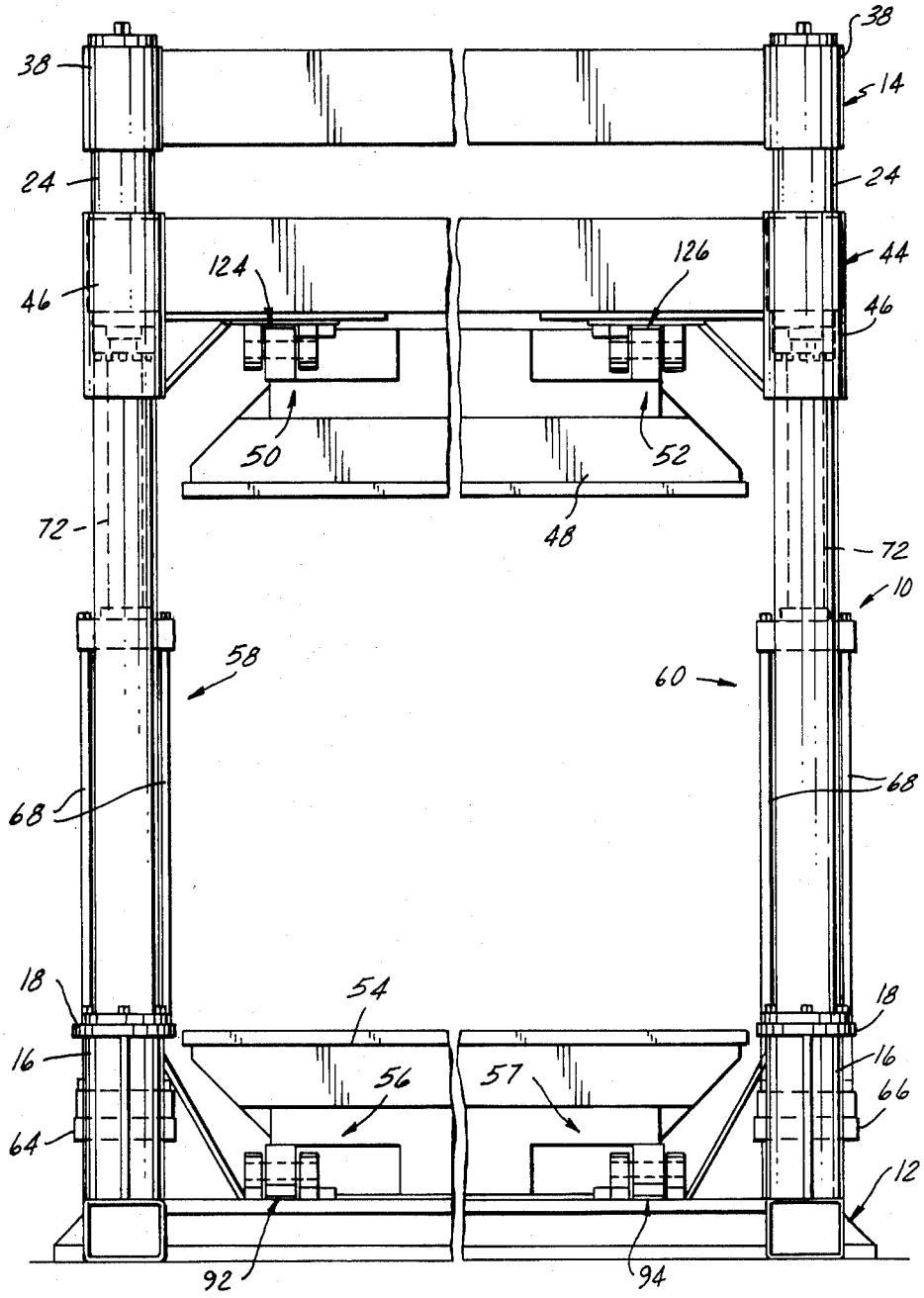
FIG. 1 is a front elevational view of a molding press including the present invention.
Figure 3:
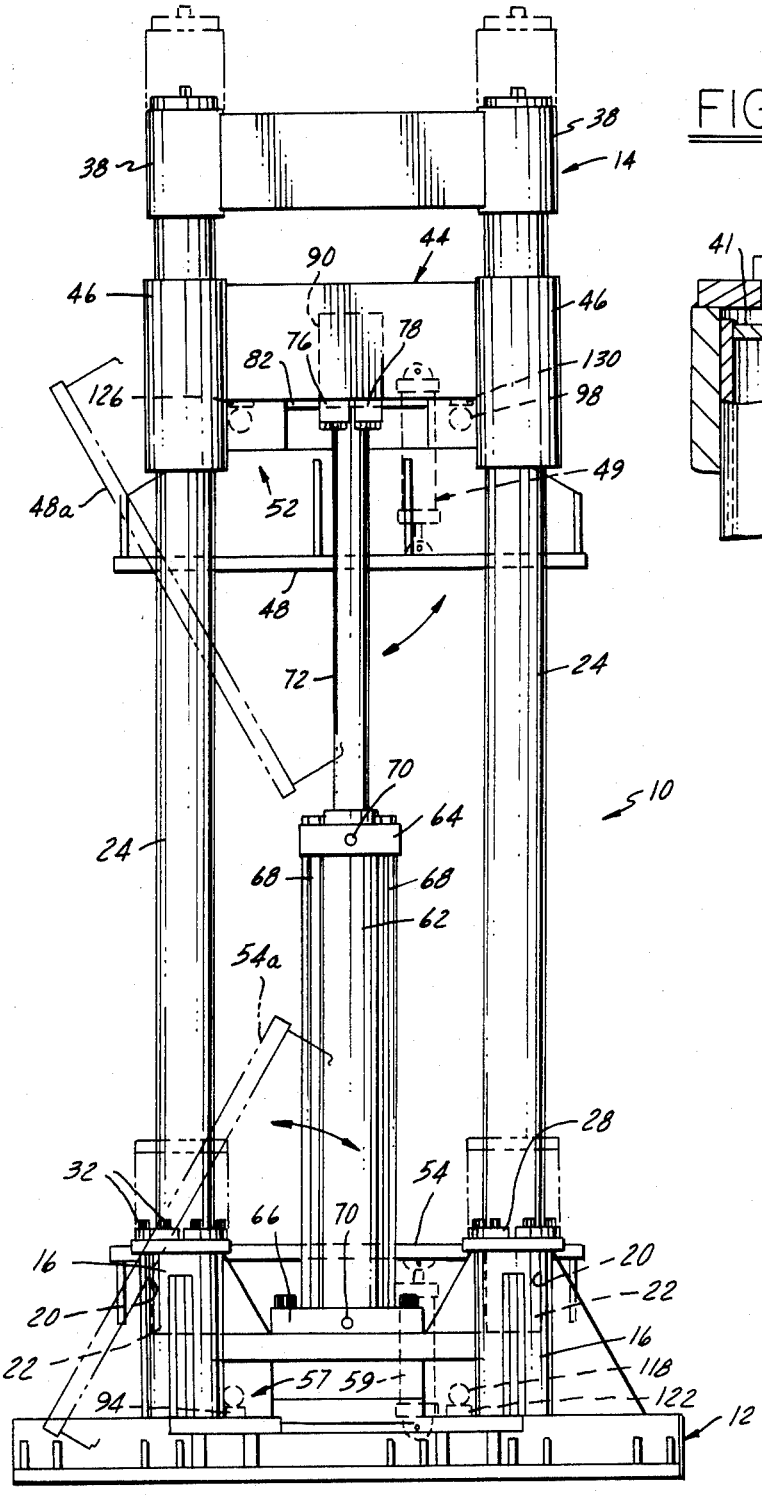
FIG. 3 is a side elevational view of the molding press of FIG. 1.
Figure 4:
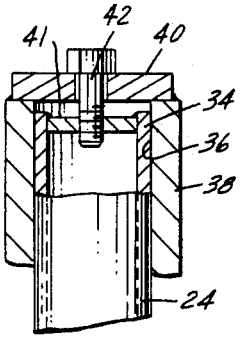
FIG. 4 is a sectional view of a tie-bar frame connector of the present invention.

FIG. 1 shows a molding press 10 having a rectangular base 12 and a top frame 14. The base 12 has a tie-bar support column 16 at each corner thereof including a collar 18. Each column 16 has an open ended recess 20 which receives the lower end 22 of a tie bar 24 as shown in FIG. 3. Each tie-bar has a groove 26 (FIG. 5) which receives tie-bar retainer segments 28,30 as shown in FIG. 6. The retainer segments 28,30 are secured by socket head cap screws 32 to the column 16 at collar 18 thereon. The upper end 34 of each tie-bar 24 is received within a bore 36 of a corner tube 38 of top frame 14. Tube 38 has a welded cover 40 which is secured to a tapped head plate 41 of tie-bar 24 by a screw 42. Each tie-bar 24 thereby is maintained vertically aligned with respect to the base.

The vertically aligned tie-bars 24 guide a movable platen 44 having corner guide tubes 46 slidably supported on the tie-bars 24. A movable booking plate 48 is supported on the underside of the platen 44 by a pair of spaced clevis and pivot pin assemblies 50,52 and a pair of lock stripping pins 96,98 (FIG. 2). The pivot axis of the assemblies 50,52 is offset forward of the center of the front to rear dimension of the base 12 so that the booking plate 48 can be pivoted by known power cylinder means 49 to the broken line position shown at **48*a* in FIG. 3. Consequently, a mold segment (not shown) supported on booking plate 48** can be accessed readily.

A lower booking plate 54 is pivotally supported to the base 12 by spaced clevis and pin assemblies 56,57 and a pair of lock stripping pins (only one shown at 118 in FIG. 3) like pins 96,98. The axis of the assemblies 56,57 is positioned in the vertical plane of the pivot axis for plate 48. Known power cylinders 59 connected between the base 12 and plate 54 position the plate 54 in parallelism to platen 44 or to a titled "booked" position shown in hidden line at **54*a* in FIG. 3. The tilted position enables an operator to have quick access to molded parts in a mold segment carried by the booking plate 54**.

Clamping pressure and mold release operation are produced by a pair of clamp cylinder assemblies 58,60 on either end of the molding press 10. Each assembly 58,60 includes a cylinder 62 with heads 64,66 held in place by corner tie bolts 68. Heads 64,66 include hydraulic ports 70 for connection to a suitable fluid power supply system. Cylinder piston rod 72 has a groove 74 that receives clamp plates 76,78 secured by socket head screws 80 to a platen plate 82. Selective pressurization of the cylinders 62 will cause the piston rods 72 either to retract to impose clamping pressure on mold segments supported in the press or to extend to open the press for booking of the booking plates 48,54.

The above-described molding press 10 has little or no deflection so that mold segments are maintained in parallelism. Further, actuation of the press is accomplished by cylinders located and operated so as not to interfere with quick access geometry.

In accordance with the invention the molding press 10 can be readily field adjusted to accept larger mold segments. The vertical mold window or throat is increased by disconnecting the tie-bar retainers 28,30. The tie-bars 24 and upper frame are raised by suitable fixtures (not shown) and a tie-bar extender 84 is located on the collar 18. The extender 84 has a ring of bolt holes 86 that extend longitudinally through the tie-bar extender 84 as illustrated in FIG. 5. The tie-bar extender 84 acts as a spacer to raise the height of the access window to the press. The tie-bars 24 are supported on top of the extenders 84 by tie-bar retainer segments 28,30 that engage tie-bar groove 26. Each segment 28,30 is connected to a collar 18 by elongated screw fasteners 88 as shown in FIG. 5.

Additionally an extender 90 may be provided to extend the length of the piston rod 72 to compensate for the increased press height as shown in FIG. 3.

The height change provided by the illustrated extenders is accomplished readily, in the field without disconnecting hydraulic power supplies on the booking plate drive cylinders. Furthermore, the height change can be accomplished without changing the vertical orientation of each of the tie-bars.

Also in the illustrated arrangement, booking plate spacers 92,94 at pivot pin assemblies 56,57 and spacers (only one shown at 122 in FIG. 3) at stripping pins (only one shown at 118) are provided on base 12 and spacers 124,126 at pivot pin assemblies 50,52 and spacers 128,130 at stripping pins 96,98 are provided on platen 44 at locations shown in FIGS. 1 through 3. Each booking plate 48,54 is positioned and locked in its load bearing horizontal position by a pair of aft located stripping pins 96,98 and 118 each driven between release and lock positions by a drive cylinder 100. The pins 96,98 and 118 couple the aft edge of the booking plates 48,54 to the frame or platen at spaced bushings 102,104 in the plates and frame or platen respectively. Clamp loads are transferred metal-to-metal between booking plates, frame and platens. The thickness of the spacers 92.94 and 124,126 and the clearances between the hinge pins 106,108 and hinge bushings 110,112 are selected so that clamp loads on the front of the booking plates are assumed by the spacers 92,94 and 124,126 and are removed from pivot hinge pins 106,108 of pin assemblies 50,52 and 56,57. The thickness of the spacers 122 and 128,130 perform the same function so that clamp loads at the rear of the booking plates are assumed by the spacers rather than the lock stripping pins 96,98 and 118.

What is claimed is:

1. In a molding press having a frame, a rectangular base, a tie-bar support column extending vertically of the base at each corner thereof, a movable platen slidably supported on the columns for movement with respect to the base, and press means for applying a mold pressure between the movable platen and the base, the improvement comprising: a pair of booking plates, means including a pair of spaced hinge bushings connected to one side and at two corners of each of said booking plates, hinge means connected to said platen and said base, and a hinge pin connecting said hinge means to each of said hinge bushings to pivotally connect each of said booking plates for hinged movement with respect to the base and platen, stripping pin means located at the opposite corners of the base and of the platen, said stripping means including a retractable pin having a connecting position in which it connects the booking plates to the base and the platen against hinged movement with respect thereto, a spacer plate located at each corner of each of said booking plates when they are held by said stripping pin against hinged movement with respect to the base and the platen, means fixedly connecting each of said spacer plates to either said base or said platen and each of said spacer plates having a thickness that will cause mold pressure to be removed from said retractable pins and said hinge pins when the booking plates are held against the base and the platen during a molding operation.

2. In a molding press including a rectangular base, a rectangular top frame having a guide means at each corner, a tie-bar support column at each corner of said rectangular base, a tie-bar extending vertically upwardly from each of said support columns, releasable tie-bar retainer means for securing each of said tie-bars to said base in vertical alignment therewith, means for securing the opposite end of each of said tie-bars to said top frame at the guide means thereof, a movable platen slidably supported by said tie-bars, first and second booking plates, pivot support means including hinge pins for pivotally connecting said first booking plate to said movable platen and said second booking plate to said base, the improvement comprising: tie-bar extender means including a tubular spacer member having opposite ends insertable between each of said tie-bar columns and each of said tie-bars, releasable means for connecting one end of each of said tubular spacer members to one of said tie-bars, one of said tie-bar support columns supporting the opposite end of one of said tubular spacer members on said base to increase the window height between said movable platen and said base when the movable platen is in its fully raised position, said tubular spacer member including a plurality of bolt holes, said releasable means including a split ring having bolt holes aligned with those of said tubular spacer member, and bolts threadably connecting said split rings and said tubular spacer members to said support columns when said tubular spacer member is supported on top of said tie-bar support columns.

* * * * *